US006059162A

United States Patent [19]

Popovich et al.

[11] Patent Number: 6,059,162

[45] Date of Patent: May 9, 2000

[54] EXHAUST BAFFLE AND SPRING ASSISTED RESET AND DAMPENER FOR POWDER ACTUATED TOOL

[75] Inventors: Michael S. Popovich, Bartlett; Edward D. Yates, Chicago, both of Ill.

[73] Assignee: Illinois Tool Works Inc., Glenview, Ill.

[21] Appl. No.: 09/174,045

[22] Filed: Oct. 16, 1998

[51] Int. Cl.[7] ..... B25C 1/14

[52] U.S. Cl. ..... 227/10; 227/9; 173/DIG. 2

[58] Field of Search ..... 227/10, 9, 8, 11; 173/DIG. 2, 212; 60/632, 638

[56] References Cited

U.S. PATENT DOCUMENTS

| | | | |
|---|---|---|---|
| 2,849,715 | 9/1958 | Kopf | 227/8 |
| 2,995,753 | 8/1961 | Henning | 227/9 |
| 3,061,833 | 11/1962 | De Caro | 227/10 |
| 3,331,546 | 7/1967 | Brunelle | 227/10 |
| 3,423,001 | 1/1969 | Bell | 227/8 |
| 3,468,465 | 9/1969 | Mulno | 227/10 |
| 3,469,504 | 9/1969 | Neighorn | 173/212 |
| 3,497,125 | 2/1970 | O'Brien | 227/10 |
| 3,534,895 | 10/1970 | Henning | 227/10 |
| 3,589,584 | 6/1971 | Ohisson et al. | 227/10 |
| 3,622,060 | 11/1971 | Gussali | 227/10 |
| 3,645,091 | 2/1972 | Ivanov et al. | 227/9 |
| 3,743,048 | 7/1973 | Bakoledis | 227/10 |
| 3,774,832 | 11/1973 | Maier | 227/10 |
| 3,895,752 | 7/1975 | Hatayama et al. | 227/10 |
| 3,910,477 | 10/1975 | Kavan | 227/10 |
| 3,929,269 | 12/1975 | Hodil | 227/10 |
| 3,942,700 | 3/1976 | Maier | 227/8 |
| 3,949,922 | 4/1976 | Hodil | 227/10 |
| 3,991,925 | 11/1976 | Buchel | 227/10 |
| 4,056,935 | 11/1977 | Gassman | 227/10 |
| 4,068,790 | 1/1978 | Osterle et al. | 227/10 |
| 4,074,844 | 2/1978 | Hodil, Jr. | 227/10 |
| 4,189,081 | 2/1980 | Combette et al. | 227/10 |
| 4,196,834 | 4/1980 | Beton | 227/10 |
| 4,375,269 | 3/1983 | Bosch et al. | 227/10 |
| 4,610,382 | 9/1986 | Ollivier et al. | 227/9 |
| 4,655,380 | 4/1987 | Haytayan | 227/10 |
| 4,711,385 | 12/1987 | Jochum | 227/10 |
| 4,809,898 | 3/1989 | Gassner et al. | 227/8 |
| 4,858,811 | 8/1989 | Brosius et al. | 227/10 |
| 4,883,212 | 11/1989 | Philipp | 227/10 |
| 4,941,391 | 7/1990 | Ehmig et al. | 227/10 |
| 5,016,802 | 5/1991 | Haytayan | 227/9 |
| 5,114,064 | 5/1992 | Jochum et al. | 227/10 |
| 5,167,359 | 12/1992 | Frommelt | 227/8 |
| 5,170,922 | 12/1992 | Ehmig et al. | 227/10 |
| 5,199,625 | 4/1993 | Dewey et al. | 227/8 |
| 5,220,123 | 6/1993 | Oehry | 227/10 |
| 5,329,839 | 7/1994 | Ehmig | 227/10 |
| 5,363,736 | 11/1994 | Huang | 227/10 |
| 5,394,702 | 3/1995 | Jochum | 60/638 |
| 5,471,903 | 12/1995 | Brede et al. | 227/10 |
| 5,538,172 | 7/1996 | Jochum et al. | 227/10 |
| 5,657,919 | 8/1997 | Berry et al. | 227/10 |
| 5,797,534 | 8/1998 | Almeras et al. | 227/10 |

FOREIGN PATENT DOCUMENTS

| | | |
|---|---|---|
| 775554 | 5/1996 | European Pat. Off. . |
| 1923911 | 11/1970 | Germany . |
| 2031994 | 8/1971 | Germany . |

*Primary Examiner*—Peter Vo
*Assistant Examiner*—Jim Calve
*Attorney, Agent, or Firm*—Mark W. Croll

[57] ABSTRACT

A powder actuated fastener setting tool including a receiver for receiving a portion of a barrel reciprocatable therein between extended and retracted positions, and a substantially enclosed exhaust baffle disposed between the receiver and a muzzle of the barrel when the barrel is in the retracted position for baffling exhaust discharged from the tool during operation thereof. The tool also includes a spring member disposed between a cap fixedly coupled axially to a muzzle of the barrel and the receiver for biasing the barrel in the extended position, and a mechanism for removing exhaust residue from the powder actuated tool during operation thereof.

26 Claims, 4 Drawing Sheets

EXHAUST BAFFLE AND SPRING ASSISTED RESET AND DAMPENER FOR POWDER ACTUATED TOOL

BACKGROUND OF THE INVENTION

The invention relates generally to powder actuated fastener setting tools, and more particularly to powder actuated fastener setting tools having an exhaust baffle and means for removing exhaust residue from the tool.

Powder actuated fastener setting tools are known and used widely, for example to fasten sill plates onto concrete slabs in the construction industry. U.S. Pat. No. 5,170,922 to Ehmig et al. discloses a tool comprising generally a barrel disposed reciprocatingly between extended and retracted positions in a receiver. The barrel is retractable in the receiver against the bias of a spring by depressing a muzzle thereof against a work piece to move a breech end of the barrel rearwardly toward a firing mechanism in a fire-ready position. The ignition of a propellant charge by the firing mechanism accelerates a piston through the barrel to set a fastener disposed previously in the muzzle thereof. The spring extends, or resets, the barrel in the receiver upon removal of the muzzle from the work piece. It is known to eliminate the spring member in other tools, particularly hand-held tools, and to reset the barrel manually, often by a throwing motion of the user's arm while holding the tool tightly.

In U.S. Pat. No. 5,170,922 to Ehmig et al., the piston is reset rearwardly toward the breech end of the barrel, for subsequent firing, by diverting a portion of the expanding gas from the discharged propellant toward the muzzle end of the barrel after setting the fastener. The rearwardly moving piston of Ehmig et al. expels the remaining expanded gas in the breech end of the barrel rearwardly and downwardly through channels that vent the gas from an underside of the tool near a hand-grip thereof. Other tools vent the gas from the muzzle end of the barrel after firing, and reset the piston by engaging a rearward end of the piston with one or more pawls extending through the barrel as the barrel is reset.

It is desirable generally to reduce or muffle noise generated by powder actuated fastener setting tools, particularly in hand-held tools operated in enclosed environments. Others have endeavored to address this problem. U.S. Pat. No. 3,743,048 to Bakoledis discloses, for example, a powder actuated fastener setting tool having a sound muffler disposed about a barrel thereof and coupled thereto by an o-ring. U.S. Pat. No. 4,196,834 to Beton discloses a fastener setting tool that vents gas radially outwardly from a rearward end of the barrel to an expansion chamber disposed thereabout where noise is suppressed, and then returns the gas from the expansion chamber back into the barrel at the muzzle end thereof. In U.S. Pat. No. 4,196,834 to Beton, the gas is ultimately discharged from the end of the barrel. U.S. Pat. No. 5,016,802 to Haytayan discloses a powder actuated setting tool that vents gas through radial ports at the muzzle end of a barrel and into a noise suppression element disposed thereabout. Other powder actuated fastener setting tools having sound suppression are disclosed in U.S. Pat. Nos. 3,743,048; 5,363,736 and 5,657,919.

The invention is drawn toward advancements in the art of powder actuated tools, and more particularly to novel tools that overcome problems in the art.

An object of the invention is to provide novel powder actuated fastener setting tools having one or more advantages over the prior art, including improved economy, improved reliability, spring assisted reset, improved noise suppression, improved recoil reduction, and improved exhaust residue removal, among other advantages disclosed further herein.

Another object of the invention is to provide novel powder actuated tools having a substantially enclosed exhaust baffle for baffling exhaust discharged from the tool during operation thereof.

A further object of the invention is to provide novel powder actuated tools having means for removing exhaust residue therefrom.

A more particular object of the invention is to provide novel powder actuated tools comprising generally a receiver for receiving a portion of a barrel that is reciprocatable therein between extended and retracted positions, and a substantially enclosed exhaust baffle disposed between the receiver and a muzzle of the barrel when the barrel is in the retracted position. In one embodiment, a cap including at least a cap end portion fixedly coupled axially to the muzzle and extending generally radially therefrom is matable with the receiver, or with a receiver sleeve extending from the receiver, when the barrel is in the retracted position to form the substantially enclosed exhaust baffle. In some embodiments, a cap sleeve extends from the cap end portion toward the receiver and is matable therewith, preferably overlapping a receiver sleeve thereof, to form the substantially enclosed exhaust baffle.

Another more particular object of the invention is to provide novel powder actuated tools comprising generally a spring member for biasing the barrel in the extended position upon removing the barrel from a work surface. The spring member may also act to connect the barrel to the remainder of the tool to increase the effective mass thereof and reduce recoil.

It is yet another more particular object of the invention to provide novel powder actuated tools comprising generally a spring member for removing exhaust residue from the powder actuated tool, particularly when the barrel of the tool is reciprocated between the extended and retracted positions.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
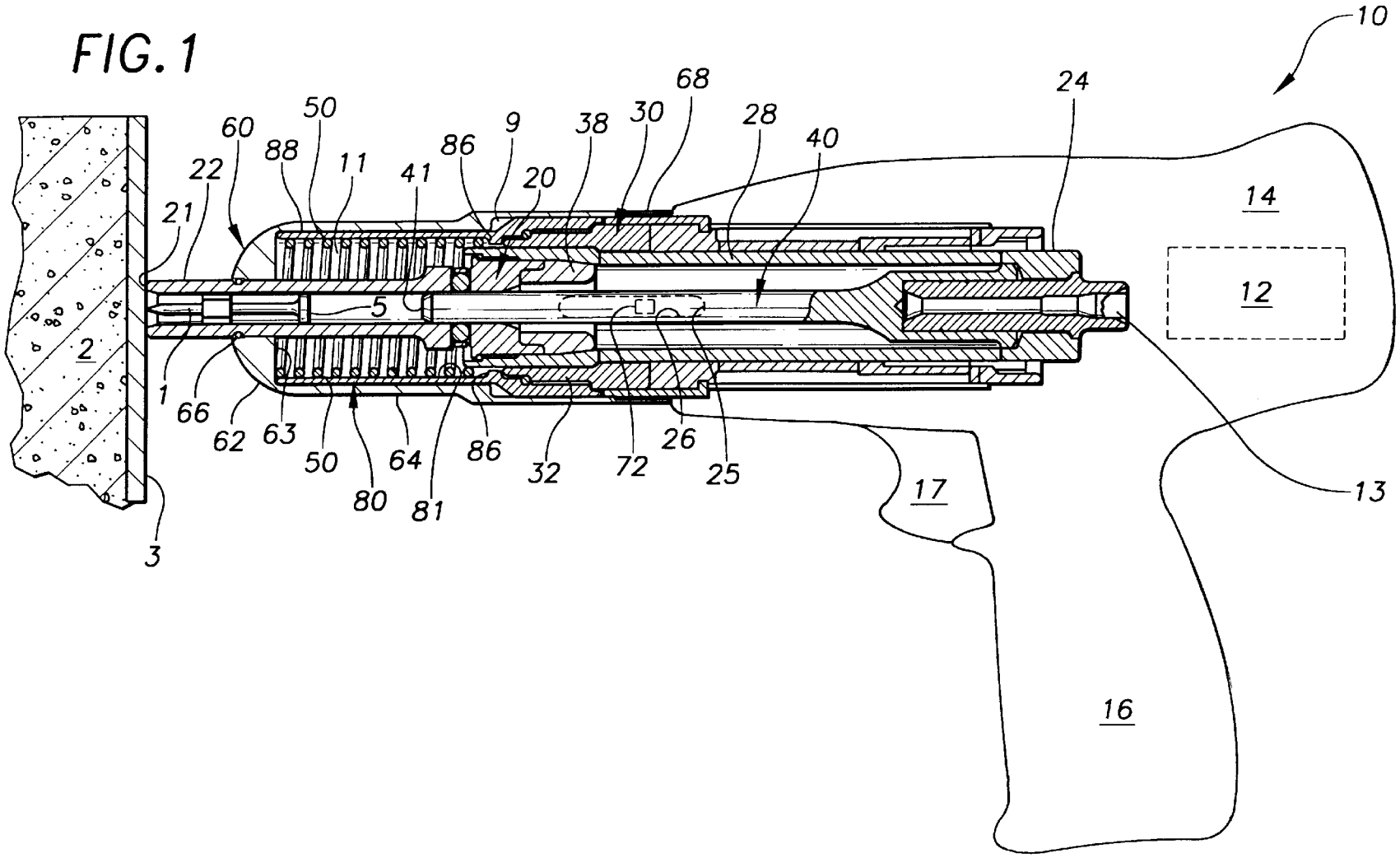
FIG. 1 is a partial sectional side view of a hand-held powder actuated fastener setting tool in a fire-ready configuration with a barrel retracted in a receiver and a piston retracted in the barrel.

FIG. 1 illustrates an exemplary powder actuated tool 10 comprising generally a barrel 20 disposed reciprocatingly in a receiver 30, and a piston 40 disposed reciprocatingly in the barrel 20 thereof. An exhaust discharge path exists between the barrel 20 and the receiver 30, whereby exhaust is expelled therefrom toward a muzzle 22 of the barrel 20 upon ignition of an explosive cartridge proximate a breech end 24 of the barrel 20, as discussed further below. The explosive charge drives the piston 40 toward the muzzle 22 to set a fastener into a work piece 2 as is known generally, for example to fasten a sill plate onto a concrete slab. FIG. 1 illustrates an end 41 of the piston 40 spaced from a head 5 of a relatively short fastener 1 disposed in the muzzle 22 when the piston 40 is in a fire ready position.

The exemplary embodiment of FIG. 1 illustrates the barrel 20 having a relatively small diameter muzzle 22 assembled with a relatively large diameter portion 28 disposed in the receiver 30 for accommodating expanding gasses during ignition of an explosive cartridge. The barrel 20 also includes a resilient member 38 disposed at a forward end of the enlarged diameter portion 28 thereof for decelerating the piston 40 as it extends fully toward the muzzle 22. In alternative embodiments, the barrel 20 may have other configurations, and may be formed as a unitary member. The muzzle 22 is generally the portion of the barrel 20 proximate the end 21 thereof from which fasteners are discharged, and in the exemplary embodiment the muzzle 22 is the relatively narrow diameter end portion of the barrel 20 coupled to the larger diameter portion 28 thereof.

Figure 2:
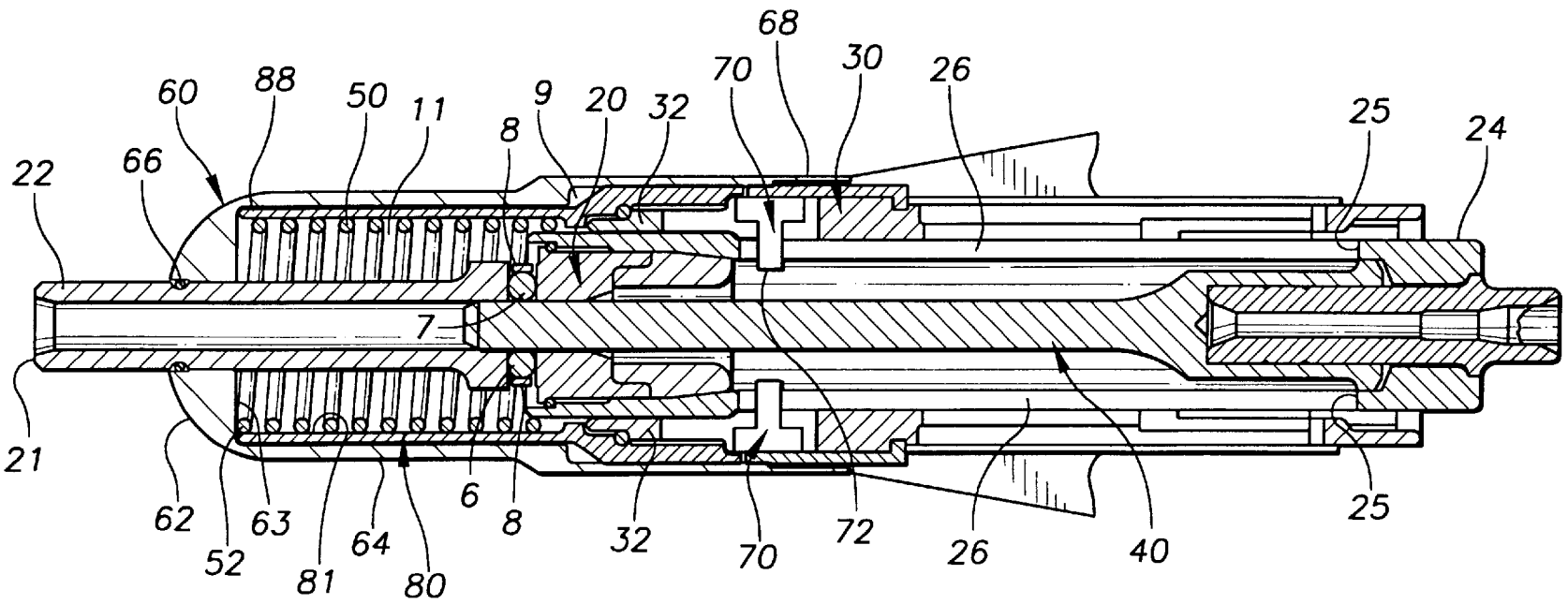
FIG. 2 is a partial top sectional view of a powder actuated fastener setting tool in the fire-ready configuration.

FIGS. 1 and 2 illustrate the barrel 20 retracted in the receiver 30, and the piston 40 retracted in the barrel 20, whereby the tool 10 is in a fire ready configuration. More particularly, the breech end 24 of the barrel 20, opposite the muzzle 22, is positioned proximate a firing mechanism 12, shown in phantom lines, disposed in the tool 10 rearwardly of the breech end 24 of the barrel 20. In FIG. 1, the barrel 20 is retracted into the receiver 30 proximate the firing mechanism 12 upon depressing the muzzle 22, and more particularly the end 21 thereof against a work surface 3 into which the fastener is to be driven. Prior to depressing the muzzle against the work surface 3, the piston 40 is retracted into the barrel 20 in a fire ready position toward the breech end 24 thereof upon extension of the barrel 20 from the receiver 30 as discussed further below.

Figure 3:
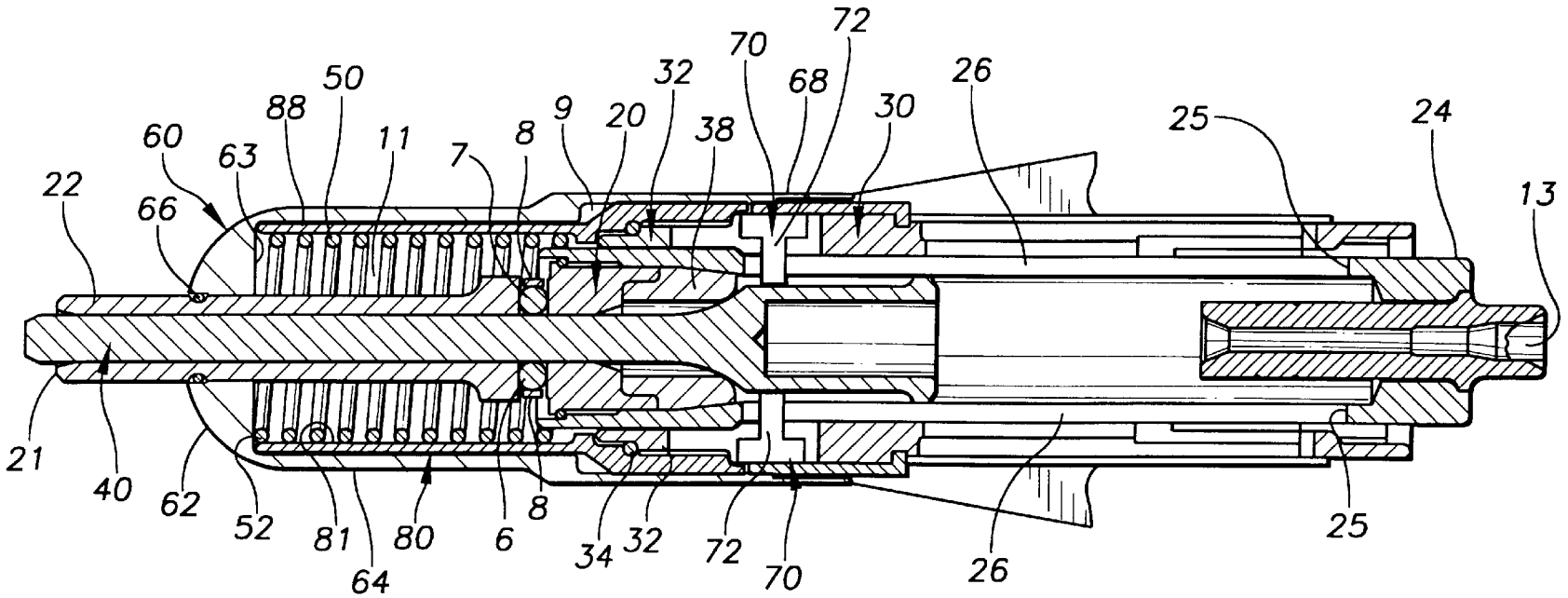
FIG. 3 is a partial top sectional view of a powder actuated tool fastener setting tool with the barrel in the retracted position and the piston in the extended position after firing.

The firing mechanism 12 ignites an explosive cartridge 13 when the barrel 20 is retracted into the receiver 30 and positioned proximate the firing mechanism 12, as is known generally in powder actuated fastener setting tools. FIG. 3 illustrates the piston 40 in its fully extended position from the barrel 20 after being driven through the barrel 20 toward the muzzle 22 by expanding gasses upon ignition of the explosive cartridge 13, whereby the piston 40 drives a fastener disposed in the muzzle 22 of the barrel from the end 21 thereof into a work piece.

Figure 4:
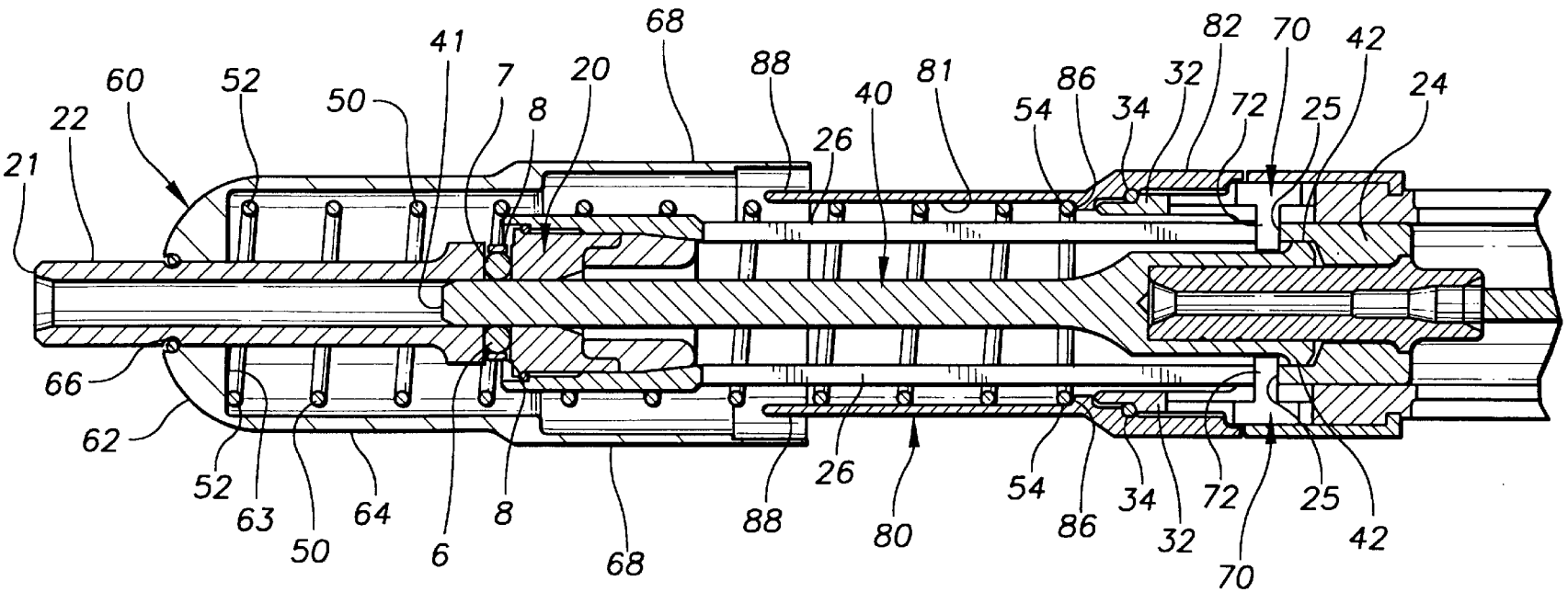
FIG. 4 is a partial top sectional view of a powder actuated fastener setting tool with the barrel extended fully in the receiver and the piston retracted in the barrel.

FIGS. 1–4 illustrate a spring member disposed between the muzzle 22 and the receiver 30 for biasing the barrel 20 in the extended position upon removing the barrel 20 from the work surface. The spring member is preferably a coil spring 50 disposed about the barrel 20 between a cap 60 fixedly coupled axially thereto and an end portion 32 of the receiver 30. FIGS. 1, 2 and 3 illustrate the barrel 20 retracted into the receiver 30, whereby the spring 50 is compressed between the cap 60 and the receiver 30, and FIG. 4 illustrates the barrel 20 biased in the extended position upon expanding the previously compressed spring 50. In alternative embodiments, the spring member may be eliminated, and the barrel 20 moved to the extended position manually, for example by a throwing action of a hand-held fastener driving tool 10.

FIGS. 2, 3 and 4 illustrate first and second pawls 70 having engagement members 72 extending from the receiver 30 and protruding through corresponding first and second elongated slots 26 disposed axially along corresponding first and second sides of the barrel 20. FIG. 1 illustrates a phantom schematic side view of one of the elongated slots 26 in the barrel 20 and the corresponding engagement member 72 protruding therethrough. The first and second elongated slots 26 of the barrel 20 permit the barrel 20 to reciprocate in the receiver 30 throughout its range of motion without interference or obstruction by the pawls 70, which are relatively stationary as the barrel 20 reciprocates relative to the receiver 30.

FIG. 4 illustrates the first and second pawls 70 generally engageable with the piston 40, and more particularly the engagement members 72 of the pawls are engageable with a flange member 42 extending radially from a rearward end portion of the piston 40. In operation, as the barrel 20 is moved forwardly to the extended position, either by the spring member or manually as discussed above, the first and second pawls 70 engage the flange member 42 of the piston 40 to limit forward movement of the piston 40 with the barrel 20 as the barrel moves forwardly in the receiver 30. The pawls 70 hold the piston 40 stationary as the barrel 20 continues to move forwardly, thereby effectively retracting the piston 40 to the breech end 24 of the barrel 20 in a fire ready position, as illustrated in FIG. 4, for subsequent firing of the tool 10.

In some embodiments, the pawls 70 limit extension of the barrel 20 from the receiver 30 upon engagement of the pawls with corresponding ends 25 of the slots 26 illustrated in FIG. 4, although other alternative means may be suitable for this purpose. In some embodiments, only a single pawl is required to reset the piston 40 in the barrel 20, but two pawls are preferred to apply a more balanced force to the piston 40 during resetting.

When the barrel 20 is in the extended position the pawls engage and retain the piston 40 toward the breech end 24 of the barrel 20, as illustrated in FIG. 4. But when the barrel 20 is retracted, the pawls do not engage the piston 40, so it is generally necessary to engage and retain the piston 40 toward the breech end 24 of the barrel 20 with other means. The barrel 20 therefore preferably includes a piston engagement member biased into frictional engagement with the piston 40 to prevent the piston 40 from moving away from the breech end 24 of the barrel 20 when the barrel 20 is retracted in the fire ready position, as illustrated in FIG. 1.

The exemplary embodiment of FIGS. 2–4 illustrate the piston engagement member comprising first and second balls 6 and 7 biased radially inwardly into engagement with the piston 40 by a spring clip member 8, although other means may be used alternatively. Thus the piston engagement member prevents the piston 40 from moving, under the influence of moderate inertial and gravitational forces, away from the breech end 24 of the barrel 20 prior to firing the tool, for example when the muzzle 22 of the tool 10 is directed downwardly toward and against a work surface, and the barrel is in the fire ready position so that the pawls 70 no longer hold the piston 40 toward the breech end 24 of the barrel 20. The expanding gas from the ignition of an explosive cartridge, however, readily overcomes the frictional forces imposed by the piston engagement member to drive the piston 40 forwardly toward a fastener in the muzzle 22 to drive the fastener therefrom and into a workpiece.

In one embodiment, the powder actuated tool 10 comprises generally a substantially enclosed exhaust baffle 11 for baffling exhaust expelled, or discharged, from the tool during operation. More particularly, exhaust is discharged or expelled from between the barrel 20 and the receiver 30 toward the muzzle 22 of the barrel 20 upon ignition of an explosive cartridge 13. The exhaust discharged between the barrel 20 and the receiver 30 communicates generally with the substantially enclosed exhaust baffle 11, which is formed between the receiver 30 and the muzzle 22 at least when the barrel 20 is in the retracted position. The exhaust discharged from between the barrel 20 and the receiver 30 is thus baffled in the substantially enclosed exhaust baffle 11.

FIG. 1 illustrates the cap 60, which is fixedly coupled axially to the barrel 20, generally matable with the receiver 30 when the barrel 20 is in the retracted position to form the substantially enclosed exhaust baffle 11. In the exemplary embodiment, the cap 60 includes a cap end portion 62 extending generally radially from the barrel 20, and a generally cylindrical cap sleeve 64 extending from the cap end portion 62 toward the receiver 30. FIGS. 1, 2 and 3 illustrate the cap sleeve 64 generally matable, preferably overlappingly, with the receiver 30 when the barrel 20 is in the retracted position to form the substantially enclosed exhaust baffle 11. The cap 60 is formed preferably of a lightweight plastic material in a molding operation, but may be formed alternatively of other materials in other operations, for example the cap may be a metal material formed in a casting operation.

The cap 60 is retained and fixedly coupled axially to the barrel, and more particularly to a portion of the muzzle 22 thereof, for example by a c-shaped retaining ring 66 disposed about the barrel 20 toward the end 21 thereof, thereby preventing the cap 60 from sliding off the end 21 of the barrel 20. In the exemplary embodiment, the spring 50 is disposed between an inner side 63 of the cap end portion 62 and the receiver 30, whereby a first end portion 52 of the spring 50 acts against the inner side 63 of cap 60 to bias the barrel 20 in the extended position, illustrated in FIG. 4. Thus the retaining ring 66 prevents the cap 60 from moving axially along the barrel toward the end 21 thereof, and the spring 50 prevents the cap 60 from moving axially along the barrel toward the receiver 30, thereby fixedly axially coupling the cap 60 to the barrel 20. In FIGS. 1, 2 and 3, the spring 50 is enclosed by the substantially enclosed exhaust baffle 11 when the barrel 20 is in the retracted position.

The exemplary embodiment also illustrates a receiver sleeve 80 extending from the receiver 30 toward the muzzle 22 of the barrel 20. FIG. 4 illustrates the receiver sleeve 80 being a generally cylindrical member having a first end portion 82 coupled to the end portion 32 of the receiver 30 by means known generally. A sealing member like an o-ring 34 may be disposed between the receiver 30 and the receiver sleeve 80 to provide an air tight seal therebetween. A second end portion 54 of the spring 50 acts against a radially inwardly protruding flange 86 of the receiver sleeve 80 to bias the barrel 20 in the extended position when the first end 52 of the spring 50 is disposed against the cap 60. The receiver sleeve 80 is formed preferably of a lightweight plastic material in a molding operation, but may be formed alternatively of other materials in other operations, for example of a metal in a metal casting operation. The receiver sleeve 80 may also be formed integrally or unitarily with the receiver 30, which is generally formed of a metal material.

In the exemplary embodiment, the cap sleeve 64 and the receiver sleeve 80 are substantially coaxially overlappable at least when the barrel 20 is in the retracted position to form the substantially enclosed exhaust baffle 11. FIG. 4 illustrates the cap sleeve 64 and the receiver sleeve 80 also substantially coaxially overlapping when the barrel 20 is in the extended position, whereby the spring 50 is enclosed by the cap sleeve 64 and the receiver sleeve 80 when the barrel 20 is in the extended position, thereby protecting the spring 50 and interior portions of the tool 10 from entanglement with, and possible damage by, the work environment.

FIGS. 1, 2 and 3 illustrate a reverse exhaust discharge path 9 extending from the exhaust baffle 11 to between the overlapping cap sleeve 64 and receiver sleeve 80 when the barrel 20 is in the retracted position. In the exemplary embodiment, the cap sleeve 64 is disposed about an outer side of the receiver sleeve 80, and the reverse exhaust discharge path 9 is directed rearwardly from a forward end portion 88 of the receiver sleeve 80 toward the receiver 30 and a rearward end 68 of the cap 60, illustrated also in FIG. 4. In other embodiments, the receiver sleeve 80 is disposed about an outer side of the cap sleeve 64 and the reverse exhaust discharge path is directed forwardly toward the end 21 of the barrel 20. Exhaust discharged into the exhaust discharge baffle 11 is ultimately exhausted, or vented, therefrom to the outside environment primarily through the reverse exhaust discharge path 9. Some exhaust may also be vented from the substantially enclosed exhaust baffle 11 between the cap 60 and the barrel 20 since the cap 60 is preferably loosely coupled thereto and may even be generally rotatable thereabout.

In an alternative embodiment, the receiver sleeve 80 is eliminated entirely, and the spring 50 is coupled directly to the receiver 30, for example the second end portion 54 of the spring 50 may be disposed and retained about the end portion 32 of the receiver 30. According to this alternative embodiment, the cap sleeve 64 extends rearwardly toward the receiver 30 sufficiently far to mate, preferably overlappingly, with receiver end portion 32 thus forming the exhaust baffle 11 when the barrel 20 is in the retracted position. In another alternative embodiment, the cap sleeve 64 is eliminated and the receiver sleeve 80 extends forwardly from the receiver 30 toward the muzzle 22 sufficiently far so that the cap 60, and more particularly the cap end portion 62 thereof is matable with the receiver sleeve 80 when the barrel 20 is in the retracted position to form the substantially enclosed exhaust baffle 11.

In another embodiment, the powder actuated tool 10 comprises generally means for removing exhaust residue from the tool 10 during operation thereof, and more particularly for removing exhaust residue as the barrel 20 is reciprocated between the extended and retracted positions relative to the receiver 30. Generally exhaust residue is loosened and removed from between the barrel 20 and the receiver 30 during reciprocation of the barrel by frictional contact therebetween. The exhaust residue removed during reciprocation of the barrel 20 is discharged generally into the substantially enclosed exhaust baffle 11, as is exhaust discharged from between the barrel 20 and the receiver 30 upon ignition of the explosive cartridge 13.

Exhaust residue is removed from the cap 60 and the receiver sleeve 80 also upon reciprocating the barrel in the receiver 30. More particularly, the overlapping cap sleeve 64 and the receiver sleeve 80 tend to engage each other frictionally thus loosening and removing exhaust residue accumulated thereon. The spring 50, disposed between the cap 60 and the receiver 30, may also frictionally engage an inner surface 81 of the receiver sleeve 80 during compression and extension thereof thereby removing exhaust residue accumulated thereon during reciprocation of the barrel 20 in the receiver 30. In other alternative embodiments, the spring 50 is frictionally engageable with the cap sleeve 64 and thus removes residue therefrom. Additionally, the compression and extension of the spring 50 tends to remove exhaust residue accumulated thereon. The cap 60 is preferably free to rotate about the barrel 20, and relative rotation and frictional contact therebetween removes exhaust residue therebetween that may obstruct venting of exhaust gas from the exhaust baffle 11.

The exemplary tool 10 of FIG. 1 is a hand-held powder actuated fastener setting tool wherein the receiver 30 is mounted or formed integrally with a body portion 14 having a pistol style hand-grip 16 and a finger actuatable trigger 17. More generally, however, the barrel 20 and receiver 30 may be part of any other powder actuated fastener setting tool, for example a stand-up fastener driving tool of the type disclosed generally in U.S. Pat. No. 5,199,625, issued Apr. 6, 1993 to Dewey et al., entitled "Fastener-Driving Tool Assembly With Improved Fastener Loading Features".

The powder actuated tool 10 of the present invention also has generally remarkably decreased recoil in comparison to comparable tools in the art. One known prior art tool is the D45 Tool available commercially from ITW Ramset/Red Head, a division of Illinois Tool Works Inc., Wood Dale, Ill. The powder actuated tool 10 of the present invention is patentably distinguished over the prior art D45 Tool by the spring assisted reset, exhaust baffle, and means for removal of exhaust gas residue, among other features of the invention discussed more fully herein. The powder actuated tool 10 of the present invention also has a longer piston and barrel muzzle, which accommodates longer fasteners, than the prior art D45 Tool.

Comparative testing and measurements performed during discharge of the tool 10 of the present invention and the prior art D45 Tool produced experimental data showing that the powder actuated tool 10 of the present invention has a substantial reduction in peak shock load during discharge. More particularly, the measured peak shock load for the prior art D45 Tool was approximately 3000 g's whereas the measured peak shock load for the tool of the present invention is approximately 2240 g's, which is a reduction of approximately 25 percent below that of the prior art D45 Tool.

The substantial reduction in peak shock load of the present tool is very likely attributable largely to the coupling of the barrel and muzzle portion thereof to the remainder of the tool by the spring member during the high acceleration loading of the tool during the firing or discharge thereof, although other factors, for example the increased mass of the longer piston, may also contribute to the reduced peak shock load measureable in the tools of the present invention.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments, but by all embodiments within the scope and spirit of the appended claims.

What is claimed is:

1. A powder actuated tool comprising:

a barrel having a muzzle;

a receiver reciprocatingly receiving a portion of the barrel, the barrel reciprocatable in the receiver between an extended position and a retracted position;

a cap coupled to the muzzle, the cap having a cap sleeve extending toward the receiver;

a portion of the cap sleeve and a portion of the receiver coaxially overlapping when the barrel is in the retracted position to form a substantially enclosed exhaust baffle between the receiver and the cap;

an exhaust discharge path formed between the overlapping portions of the cap sleeve and the receiver, whereby exhaust gas is ventable from said exhaust baffle along said exhaust discharge path.

2. The powder actuated tool of claim 1, the cap having a cap end portion fixedly coupled axially to the muzzle and extending generally radially therefrom, the cap sleeve extending from a radial outer portion of the cap end portion toward the receiver, a portion of the cap sleeve disposed substantially coaxially about a portion of the receiver when the barrel is in the retracted position, the exhaust discharge path extending from the substantially enclosed exhaust baffle toward the receiver.

3. The powder actuated tool of claim 2 further comprising a receiver sleeve extending from the receiver toward the muzzle, the cap sleeve disposed about and substantially coaxially overlapping the receiver sleeve when the barrel is in the extended and retracted positions.

4. The powder actuated tool of claim 3, the exhaust discharge path extending between the overlapping portions of the cap sleeve and receiver sleeve.

5. The powder actuated tool of claim 1 further comprising an internal exhaust discharge path between the receiver and the barrel, the internal exhaust discharge path communicating with the exhaust baffle when the barrel is in the retracted position.

6. The powder actuated tool of claim 1 further comprising a spring member disposed between the cap and the receiver, the spring member biasing the barrel in the extended position, the spring member enclosed by the substantially enclosed exhaust baffle when the barrel is in the retracted and extended positions.

7. The powder actuated tool of claim 6 further comprising a piston reciprocatingly disposed in the barrel between an extended position and a retracted position, a first pawl extending from the receiver and protruding through a first elongated slot disposed axially along a first side of the barrel, the first pawl engageable with the piston, whereby the first pawl moves the piston to the retracted position when the barrel is moved to the extended position.

8. The powder actuated tool of claim 7 further comprising a second pawl extending from the receiver and protruding through a second elongated slot disposed axially along a second side of the barrel, the second pawl engageable with the piston, whereby the first and second pawls move the piston to the retracted position when the barrel is moved to the extended position.

9. A powder actuated tool comprising:

a barrel having a muzzle;

a receiver reciprocatingly receiving a portion of the barrel, the barrel reciprocatable in the receiver between an extended position and a retracted position;

a substantially enclosed exhaust baffle disposed between the receiver and the muzzle when the barrel is in the retracted position; and means for removing exhaust residue from the powder actuated tool as the barrel is reciprocated between the extended position and the retracted position.

10. The powder actuated tool of claim 9 further comprising an exhaust discharge path between the receiver and the barrel, the exhaust discharge path communicating with the substantially enclosed exhaust baffle when the barrel is in the retracted position.

11. The powder actuated tool of claim 9 further comprising a cap having a cap end portion fixedly coupled axially to the muzzle and extending generally radially therefrom, the cap having a cap sleeve extending from the cap end portion toward the receiver, the cap sleeve and the receiver coaxially overlapping when the barrel is in the retracted position to form the substantially enclosed exhaust baffle.

12. The powder actuated tool of claim 11 further comprising the means for removing exhaust residue comprising a spring member disposed between the cap end portion and the receiver.

13. The powder actuated tool of claim 9 further comprising:

a receiver sleeve extending from the receiver toward the muzzle; and a cap having a cap end portion fixedly coupled axially to the muzzle and extending generally radially therefrom, the cap having a cap sleeve extending from the cap end portion toward the receiver, the cap sleeve and the receiver sleeve substantially coaxially overlapping at least when the barrel is in the retracted position to form the substantially closed exhaust baffle.

14. The powder actuated tool of claim 13 further comprising the means for removing exhaust residue comprising a spring member disposed between the cap end portion and the receiver, the spring member engageable with one of the cap sleeve and the receiver sleeve when reciprocating the barrel between the extended and retracted positions to remove exhaust residue from the powder actuated tool.

15. The powder actuated tool of claim 13 further comprising a reverse exhaust discharge path between the overlapping portions of the cap sleeve and the receiver sleeve when the barrel is in the retracted position.

16. A method for baffling exhaust discharged from a powder actuated tool, the method comprising;

reciprocatingly disposing a barrel between extended and retracted positions in a receiver;

discharging exhaust from between the barrel and the receiver toward a muzzle of the barrel;

baffling exhaust discharged from between the barrel and the receiver in a substantially enclosed exhaust baffle formed between overlapping portions of the receiver and a cap sleeve coupled to the barrel, venting exhaust from the exhaust baffle along an exhaust discharge path extending between overlapping, portions of the cap sleeve and the receiver when the barrel is in the retracted position.

17. The method of claim 16 further comprising removing exhaust residue from the powder actuated tool when reciprocating the barrel in the receiver between the extended and retracted positions.

18. The method of claim 16 further comprising forming the substantially enclosed exhaust baffle by substantially coaxially overlapping a receiver sleeve extending from the receiver toward the muzzle with the cap sleeve coupled to a cap end portion fixedly coupled axially to the muzzle when the barrel is in the retracted position.

19. The method of claim 18 further comprising removing exhaust residue from the powder actuated tool by engaging a spring member disposed between the cap end portion and the receiver with one of the cap sleeve and the receiver sleeve when reciprocating the barrel between the extended and retracted positions.

20. The method of claim 18 further comprising removing exhaust residue from the powder actuated tool by engaging the cap sleeve with the receiver sleeve when reciprocating the barrel between the extended and retracted positions.

21. The method of claim 18 further comprising removing exhaust residue from the powder actuated tool by engaging the cap sleeve with the receiver sleeve when reciprocating the barrel between the extended and retracted positions.

22. The method of claim 18 venting exhaust from within the substantially enclosed exhaust baffle toward the receiver along a reverse exhaust discharge path extending between overlapping portions of the cap sleeve and receiver sleeve when the barrel is in the retracted position.

23. The method of claim 22 further comprising venting exhaust from within the substantially enclosed exhaust baffle between the cap end portion and the barrel.

24. The method of claim 16 further comprising biasing the barrel in the extended position with a spring disposed between the cap disposed about the barrel and the receiver, and enclosing the spring within the exhaust baffle when the barrel is in the extended and retracted positions.

25. A powder actuated tool comprising:

a barrel having a muzzle;

a receiver receiving a portion of the barrel, the barrel reciprocatable in the receiver between extended and retracted positions;

a cap coupled to the muzzle, the cap having a sleeve extending toward the receiver;

a portion of the cap sleeve and a portion of the receiver overlapping when the barrel is in the retracted and extended positions; an exhaust baffle formed between the receiver and the cap and an exhaust discharge path formed between the overlapping portions thereof when the barrel is in the retracted positions;

a spring disposed about the barrel between the receiver and the cap, the spring enclosed by the exhaust baffle when the barrel is in the extended and retracted positions.

26. The powder actuated tool of claim 25 further comprising a receiver sleeve extending from the receiver toward the muzzle, the cap sleeve disposed about and coaxially overlapping the receiver sleeve when the barrel is in the extended and retracted positions.

* * * * *